US005577541A

United States Patent [19]

McKeon

[11] Patent Number: 5,577,541

[45] Date of Patent: Nov. 26, 1996

[54] ROLLING DOOR ASSEMBLY HAVING PASS DOOR ARRANGEMENT

[75] Inventor: James M. McKeon, Brooklyn, N.Y.

[73] Assignee: Mckeon Rolling Steel Door Co., Inc., Brooklyn, N.Y.

[21] Appl. No.: 584,916

[22] Filed: Jan. 11, 1996

Related U.S. Application Data

[63] Continuation of Ser. No. 354,208, Dec. 12, 1994, abandoned.

[51] Int. Cl.[6] ..... E05F 15/20

[52] U.S. Cl. ..... 160/7; 160/9; 160/116; 160/133

[58] Field of Search ..... 160/7, 113, 116, 160/180, 133, 185, 186, 127, 9, 1, 23.1, 32, 41, 98, 189, 239, 271, 272, 273.1, 310

[56] References Cited

U.S. PATENT DOCUMENTS

| | | | |
|---|---|---|---|
| 812,722 | 2/1906 | Cahill | 160/116 |
| 888,862 | 5/1908 | Wilson | 160/116 |
| 1,413,895 | 4/1922 | Claveria | 160/116 |
| 1,549,714 | 8/1925 | Claveria | 160/116 X |
| 1,961,674 | 6/1934 | Moss | 160/116 |
| 3,090,424 | 5/1963 | Carlo | 160/116 X |
| 3,717,194 | 2/1973 | Gerken | 160/133 X |
| 4,147,197 | 4/1979 | Bailey et al. . | |
| 4,217,731 | 8/1980 | Saino . | |
| 4,461,120 | 7/1984 | Hemmerling . | |
| 4,754,795 | 7/1988 | Garrod . | |
| 5,022,452 | 6/1991 | Burrell . | |

FOREIGN PATENT DOCUMENTS 1197732 7/1970 United Kingdom .

OTHER PUBLICATIONS

Portion of sales brochure of Steelcraft Folding Gate Corp., Brooklyn, New York.

Portion of sales brochure of Kinnear Mfg. Co., Columbus, Ohio.

Portion of sales brochure of J. G. Wilson Corp., New York, New York, copyrighted 1923.

Portion of sales brochure of Won-Door Corporation.

Portion of sales brochure of American Metal Door Company, Inc.

Portion of sales brochure of Vickroy Fire Tech Inc.

Portion of sales brochure of SAJ, Inc.

*Primary Examiner*—David M. Purol

*Attorney, Agent, or Firm*—Cohen, Pontani, Lieberman, Pavane

[57] ABSTRACT

A rolling door assembly for selectively covering an opening in a building includes a shutter roller rotatable about a substantially horizontal axis and a flexible panel windable on and off the roller for movement into retracted and extended conditions, respectively. The flexible panel defines an upper portion having a first width and a lower portion having a second width less than the first width. At least one pass door frame is hingedly securable proximate a lateral side of the opening for movement between a first position, in which the pass door frame extends in a substantially transverse direction relative to the opening and a second position, in which the pass door frame is substantially aligned with the at least one sidewall, the pass door frame defining a passage therethrough and a substantially vertical channel for guiding an edge region of the flexible panel lower portion as it is extended. A pass door is movably mounted within the passage defined by the pass door frame to selectively provide ingress and egress therethrough and a closure system is provided for causing the pass door frame to move from the second position to the first position prior to extension of the flexible panel.

19 Claims, 5 Drawing Sheets

ROLLING DOOR ASSEMBLY HAVING PASS DOOR ARRANGEMENT

This is a continuation of application Ser. No. 08/354,208, filed Dec. 12, 1994, now abandoned.

BACKGROUND OF THE INVENTION

1. Field of the Invention

The present invention relates generally to a movable door for selectively covering an opening in a wall, and more particularly to an improved egress assembly in the movable door for allowing passage therethrough when the wall opening is covered.

2. Discussion of the Background Art

A "labeled" door assembly is defined by the National Fire Protection Association as a combination of a door, hardware and other accessories which together provide a specific degree of protection to an opening when closed and to which has been attached a label or other identifying mark to indicate compliance with nationally recognized standards or tests. Conversely, all other door assemblies are referred to as "non-labeled" door assemblies.

For emergency egress purposes, various building codes and the like require any building having either a slide-type or rolling type door assembly to include both a fire door positionable to close an opening and a hinged-type wicket or pass door for passage therethrough when the opening is closed by the fire door. In some cases, compliance with the above requirement may be achieved merely by providing the pass door in the wall of the building adjacent the fire door. Alternatively, a pass door may be incorporated into the movable fire door itself. In U.S. Pat. Nos. 4,217,731 and 4,461,120, for example, there are shown fire door assemblies which include a single hinged pass door in a sliding fire door for allowing passage through the sliding fire door. As will be readily appreciated, however, sliding fire doors may be unattractive to building designers because of the need to provide adjacent wall space to accommodate them. This same need for adjacent space may also complicate or frustrate efforts to retrofit a sliding door over an existing opening.

In an effort to avoid the space problems and other disadvantages associated with slide-type door assemblies, rolling door assemblies, which include a shutter curtain that is raised or lowered from a roller positioned above the opening, have been developed. Typically, two vertically disposed channels are positioned adjacent opposite lateral sides of the opening to guide the shutter curtain as it is retracted or extended between the opened and closed positions.

While a service door configuration is known in which a pass door frame is hingedly connected to a vertical, shutter guide channel to provide passage when the rolling curtain service door is closed, this configuration utilizes a door frame structure that must be manually positioned and locked prior to extension of the shutter curtain. As such, this configuration can not be utilized in self-closing fire door applications in which the rolling door is closed automatically, such, for example, in response to detection of a fire.

SUMMARY OF THE INVENTION

Accordingly, it is an object of the present invention to provide a self-closing fire door assembly which provides emergency egress through a protected opening while avoiding the deficiencies noted above in connection with prior art labeled door assemblies. This object, as well as others which will become apparent from the teachings set forth herein to those skilled in the art, are achieved by a fire door assembly that includes a shutter roller rotatable about a substantially horizontal axis, means for rotating the shutter roller and a flexible panel windable on and off the shutter roller for movement into retracted and extended conditions, respectively. The flexible panel defines an upper portion having a first width and a lower portion having a second width less than the first width.

In accordance with one aspect of the present invention, the door assembly includes a pass door frame hingedly securable proximate a lateral side of the opening for movement between a first position, in which the pass door frame extends in a substantially transverse direction relative to the opening and a second position, in which the pass door frame is substantially aligned with a sidewall of the opening. The pass door frame defines a passage therethrough and a substantially vertical channel for guiding an edge region of the flexible panel lower portion while in the first position.

A pass door is movably mounted within the passage defined by the pass door frame to selectively provide ingress and egress therethrough. The door assembly of the present invention further include closure means for causing the pass door frame to move from the second position to the first position prior to extension of the flexible panel.

In accordance with a preferred embodiment of the present invention, the door assembly comprises two pass door frames with one pass door frame being disposed at each lateral side of the opening and each having a door movably mounted within the passage defined thereby. To accommodate movement of each pass door frame into its first position, the sum of the widths of the pass door frames may not exceed the difference between the width of the upper portion of the flexible panel and the lower portion of the flexible member. The lower portion of the flexible panel defines an increased thickness portion disposed along a bottom portion thereof, and the fire door assembly further includes a floating member defining a vertical slot having a length at least equal to the width of the lower portion of the flexible panel and a width less than the thickness of the increased thickness portion.

The lower portion of the flexible panel is slidably positioned within the slot such that when the flexible panel is partially unwound, the floating member comes to rest on a respective upper surface portion of each pass door frame, thereby aligning the lower portion of the flexible door with the guiding grooves defined therein. After the floating member has assumed this aligning position, continued extension of the flexible panel positions the lower portion thereof across the portion of the opening defined between the two pass door flames. Passage through the opening can now be achieved only via one or both of the pass doors until and unless the flexible panel is retracted.

Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

BRIEF DESCRIPTION OF THE DRAWINGS

In the drawings, wherein like reference characters denote similar elements throughout the several views.

DETAILED DESCRIPTION OF THE INVENTION

Figure 1:
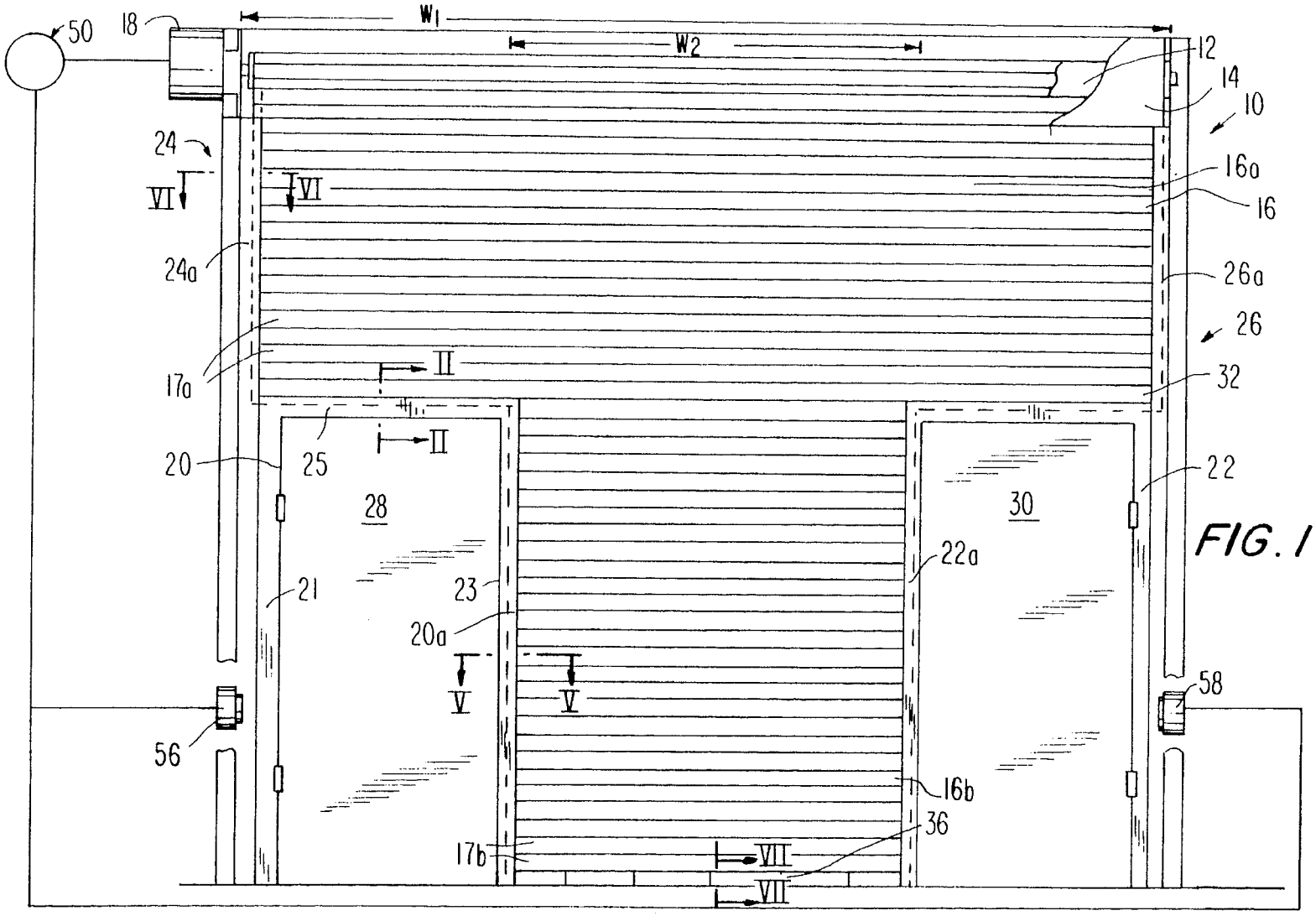
FIG. 1 is a front elevation view of a fire door assembly constructed in accordance with an illustrative embodiment of the present invention, with the flexible door panel and pass door frames shown in their respective closed positions across an opening.

With initial reference to FIG. 1, there is shown an illustrative door assembly 10 embodying the invention and comprising a shutter roll 12 horizontally and rotatably arranged within a housing 14. Wrapped about shutter roll 12 is a flexible door panel 16. In the illustrative embodiment of the present invention depicted in FIG. 1, door assembly 10 is a labeled fire door assembly and flexible door panel 16 is formed from a plurality of horizontal metallic slats 17*a*, 17*b* that are articulated together in a known manner. The principal advantages of roll-type door structures are derived from their minimal space requirements and out-of-the way placement above an opening when in an inactive condition. As will be readily appreciated by those skilled in the art, the flexible door panel employed in a roll-type door structure need not be of an articulated slat configuration and any suitable rolling door configuration possessing the desired characteristics of flexibility, durability, and if applicable, resistance to fire, may be utilized.

When not needed, flexible door panel 16 may be maintained entirely within housing 14 while in a wound, retracted condition but may also, in accordance with an operating sequence to be described in detail later, be unwound by a conventional power drive means 18 into the extended condition shown in FIG. 1. It should be noted that power drive means 18 is not considered a novel aspect of the present invention and that any suitable means may be employed to rotate shutter roll 12 to thereby cause extension or retraction of flexible door panel 16. Because suitable mechanisms for this purpose are well known in the art, a detailed description of the same has therefore been deemed unnecessary and has been omitted for clarity.

With continued reference to FIG. 1, it will be seen that flexible door panel 16 has an upper portion 16*a* of a width $W_1$ and a lower portion 16*b* of a width $W_2$ that is less than $W_1$ by an amount sufficient to accommodate, when extended, at least one pass door frame 20. In the illustrative embodiment of FIG. 1, door assembly 10 further includes a second pass door frame 22, with each door frame being disposed at opposite lateral sides of the opening and movable into the transverse or closed position relative to the opening as shown.

As will be described in detail later, first and second vertical track members 24, 26 define recesses 24*a*, 26*a*, respectively, for receiving and guiding corresponding lateral edge regions of upper portion 16*a* while inwardly facing portions of pass door frames 20 and 22 define recesses 20*a*, 22*a*, respectively, for receiving and guiding corresponding lateral edge regions of lower portion 16*b*. Mounted within the passage defined by each of pass door frames 20 and 22, is a corresponding hinged personnel or pass door 28, 30. When flexible panel 16, door frames 20, 22, and pass doors 28, 30 are positioned as shown in FIG. 1, a fire barrier is established across the opening. Emergency egress or ingress is obtained through flexible panel 16 via one or both of pass doors 28, and 30.

As is apparent from FIG. 1, vertical track members 24 and 26 are too far apart to guide lower portion 16*b* during initial extension of flexible door panel 16 from the retracted or wound position. In accordance with the present invention, aligning means are provided to ensure proper registration of the lower portion 16*b* with the inwardly facing recesses of door frames 20 and 22. In the illustrative door assembly 10 of FIG. 1, the aligning means is in the form of an elongated, floating member 32 which spans substantially the entire width of the opening, with opposite lateral ends thereof being received for guided movement within the inwardly facing grooves 24*a*, 26*a* of vertical track members 24 and 26.

Figure 4:
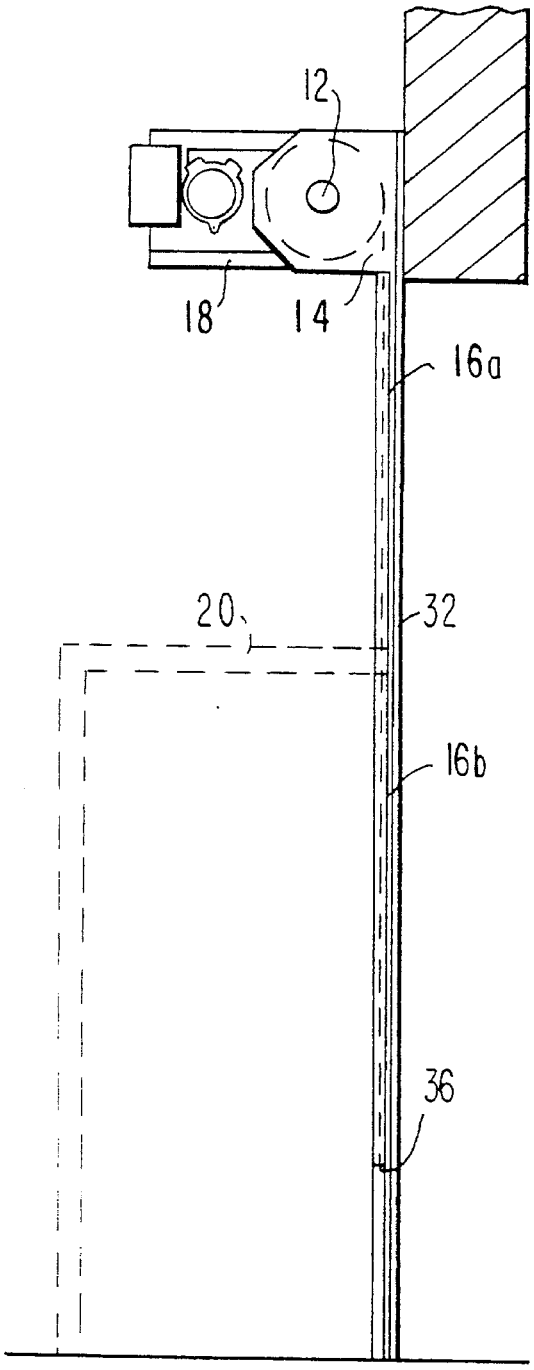
FIG. 4 is a side elevation view taken in cross-section showing continued extension of the flexible door panel beyond the position shown in FIG. 3.
Figure 2:
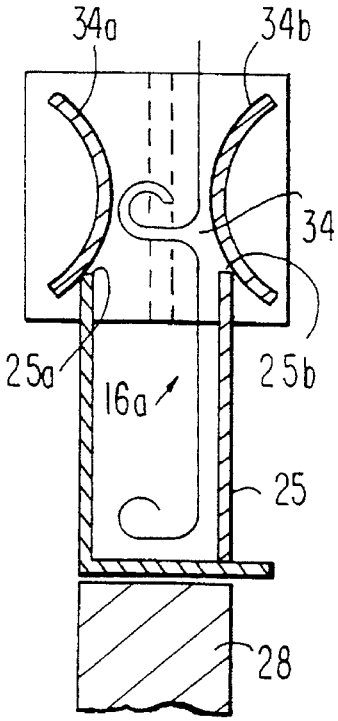
FIG. 2 is a partial cross sectional view taken across line II—II in FIG. 1.
Figure 3:
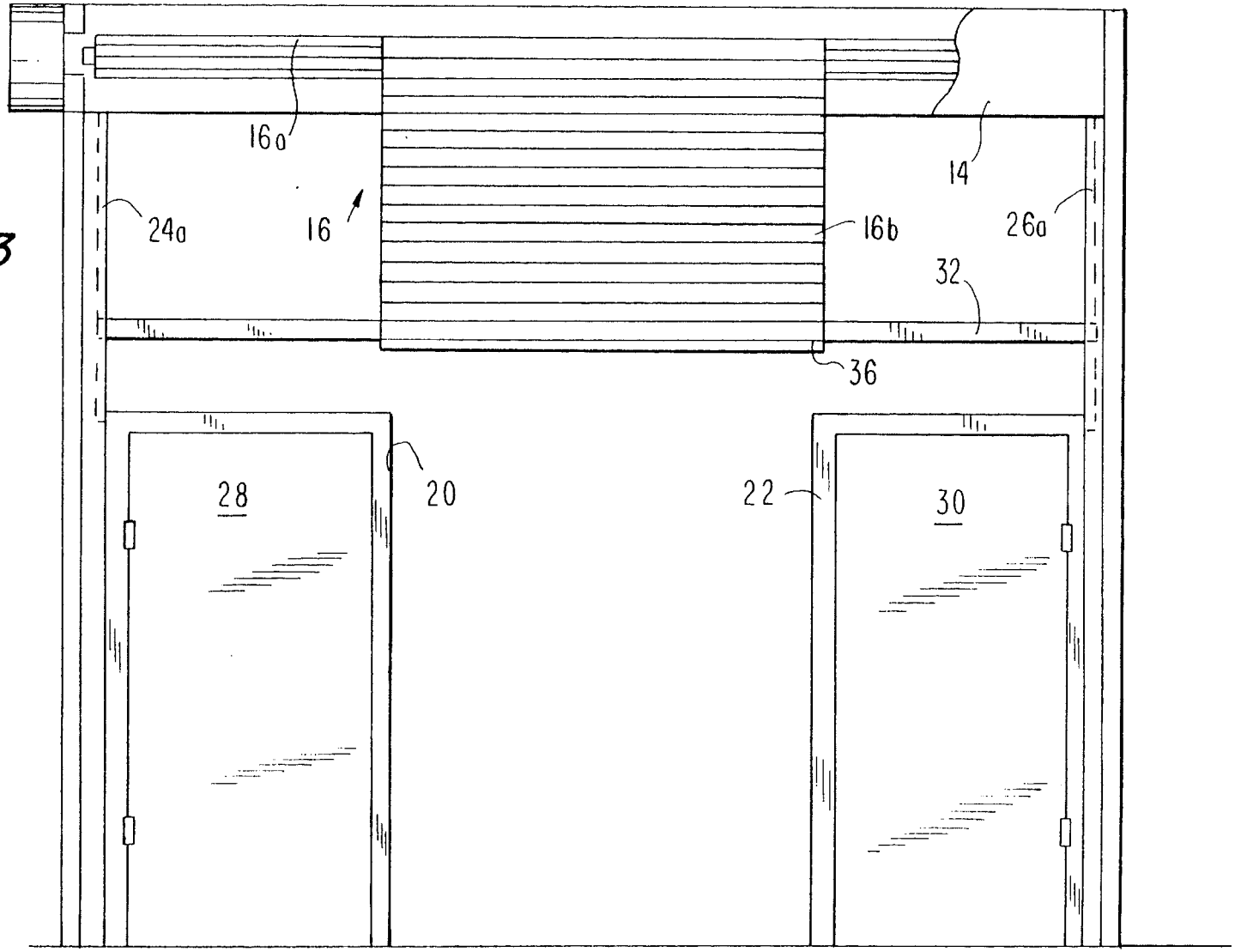
FIG. 3 is a front elevation view of the fire door assembly of FIG. 1, with the flexible door panel shown in a partially extended position.

As best shown in FIG. 2, floating member 32 defines a vertical slot 34 having a length slightly greater than $W_2$ and a width slightly greater than the thickness of flexible door panel 16. The lower portion 16*b* of flexible door panel 16 is slidably disposed within slot 34 and defines an increased thickness portion 36 (FIG. 1 ) disposed along a bottom portion thereof. Thus, as best shown in FIG. 3, floating member 32 assumes an aligning position relative to flexible panel portion 16*b* during initial extension thereof. Once the lower surface 32*a* of floating member 32 contacts the upper surfaces of pass door frames 26, 28, respectively (FIGS. 1 and 4), however, alignment of lower portion 16*b* by the inwardly facing grooves of the pass door frames is ensured and further downward movement of the floating member 32 is neither possible nor necessary during the remaining extension.

If only one emergency pass door is required, one of the pass door frames, as pass door frame 22, may be omitted. In such a modified configuration, one lateral edge of lower portion 16*b* may be substantially coplanar with a corresponding lateral edge portion of upper portion 16*a*. It may be necessary to provide an abutment, or some other suitable structure, within recess 24*a* of guide member 24 to engage a lateral end portion of the floating bar 32 once the opposite lateral end portion has been engaged by the upper surface of pass door frame 22. Such an arrangement may be utilized, for example, to retain the floating bar in a substantially horizontal position as extension of the increased thickness region continues below the upper surface of the pass door frame, thereby preventing jamming or warping of the flexible panel 16 during extension.

In the illustrative door assembly 10 of FIG. 1, both pass door frames 20, 22 are shown as being of substantially identical construction. Accordingly, only pass door frame 20 will be hereinafter described in detail. As seen in FIG. 1, pass door frame 20 is of a substantially rectangular construction and includes first and second vertical frame sections 21 and 23 interconnected by an upper transverse frame section 25. With reference to FIG. 2, it will be seen that upper frame section 25 an interior channel and has a substantially U-shaped cross section and that the slot 34 of floating member 32 is defined by inwardly facing, convex sidewall surfaces 34*a* and 34*b*. When floating member 32 is positioned across flexible panel 16 so as to rest upon the upper surfaces 25*a*, 25*b* of upper frame section 25, an effective fire seal is provided along the upper surface of pass door frame 20.

Figure 5:
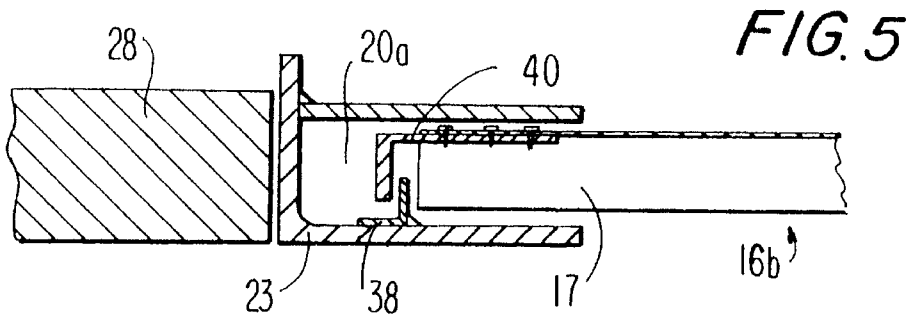
FIG. 5 is a partial cross sectional view taken across line V—V in FIG. 1.

With reference now to FIG. 5, it will be seen that vertical frame section 23 defines the abovedescribed vertical recess or channel 20*a* of pass door frame 20. As shown, section 23 has a substantially U-shaped cross section with the base 23*a* facing the exterior edge of pass door 28. Channel 22*a* of pass door frame 22 is configured in an identical manner. The depth of each channel as channel 20*a* is selected so as to accommodate a corresponding lateral edge portion of flexible door panel 16. Interlocking structures are preferably provided within channels 20*a*, 22*a* in order to limit lateral movement of the extended flexible panel member 16, and thus prevent dislocation of the same from the channel. Such structures may also restrict the flow of air around the lateral edge of the flexible panel during a fire. By way of specific example, corresponding members 38 and 40 having an L-shaping cross section may be secured, respectively, to the inner surface of channels 20*a*, 22*a* and the lateral edge portions of each slat 17*b* of lower portion 16*b*.

Figure 6:
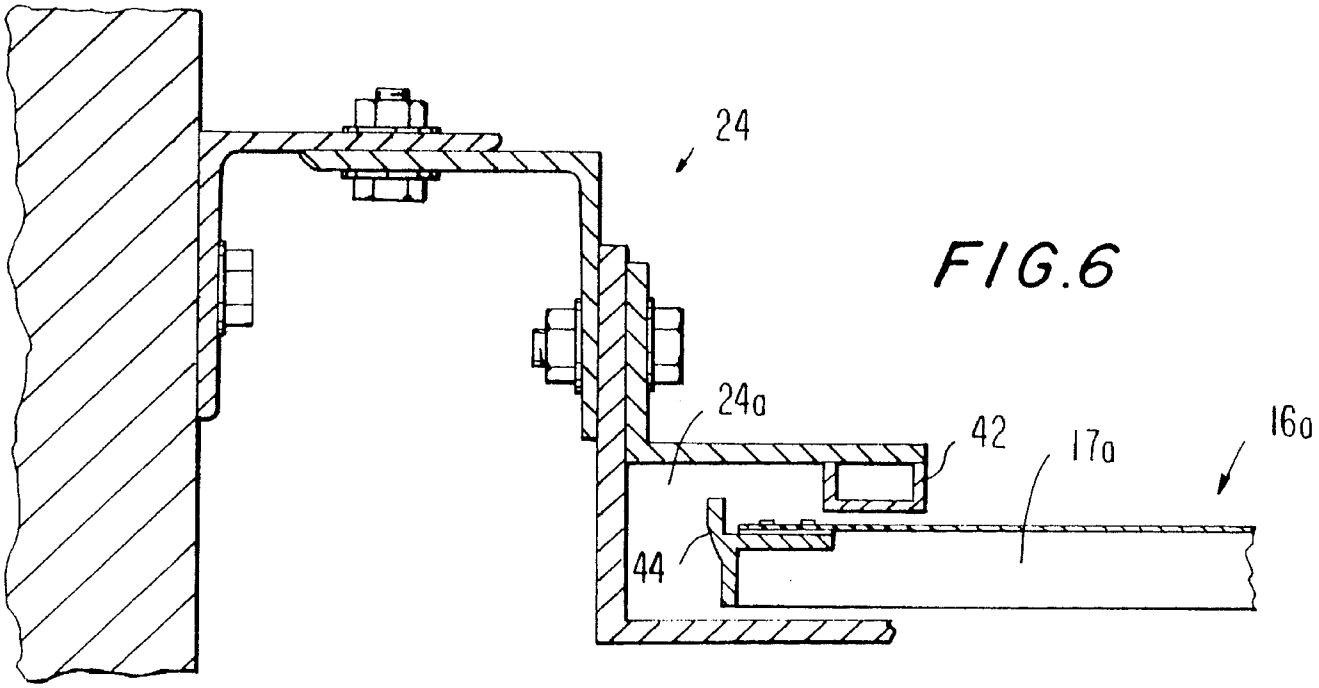
FIG. 6 is a partial cross sectional view taken across line VI—VI in FIG. 1.

It is also desirable to provide some means of preventing lateral movement of upper door portion 16*a* from the channels 24*a*, 26*a* of vertical guide members 24 and 26. Thus, as shown in FIG. 6, the inner surface of each channel as channel 24*a* includes an inwardly directed abutment 42 which extends the length thereof. Each slat 17*a* of upper flexible door portion 16*a* has a corresponding extension 44 structure which will engage abutment 42 if any effort is made to dislodge, as by pushing, the flexible panel therefrom.

Figure 7:
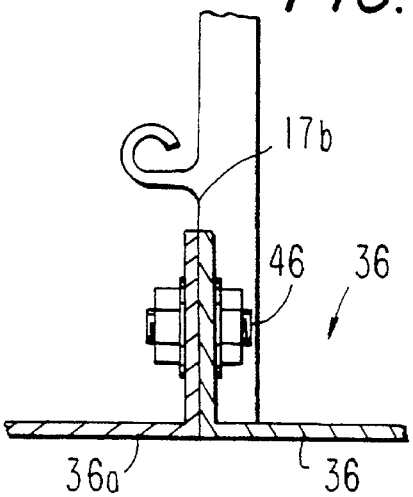
FIG. 7 is a partial cross sectional view taken across line VII—VII in FIG. 1.

With simultaneous reference now to FIGS. 1 and 7, it will be recalled that an increased thickness portion 36 along the bottom of flexible panel portion 16*b* retains the floating member 32 in a substantially horizontal position unless support is provided by pass door frames 20 and 22. It is, of course, possible to specially fabricate the lowest articulated slat of lower portion 16*b* so as to define the increased thickness portion 36. In accordance with the illustrative embodiment depicted in FIG. 1, however, an articulated, increased thickness structure is achieved by coupling a pair of elongated members proximate the bottom edge of the flexible door panel portion 16*b*. Specifically, and as shown in FIG. 7, increased thickness portion 36 is constructed by securing two elongated members 36*a*, 36*b* having an L-shaped cross section in a back-to-back arrangement to articulated slat 17*b*. Of course, any suitable fastening means, such as mechanical fasteners 46 arranged at appropriate intervals along the increased thickness portion 36 may be employed for this purpose.

Figure 8:
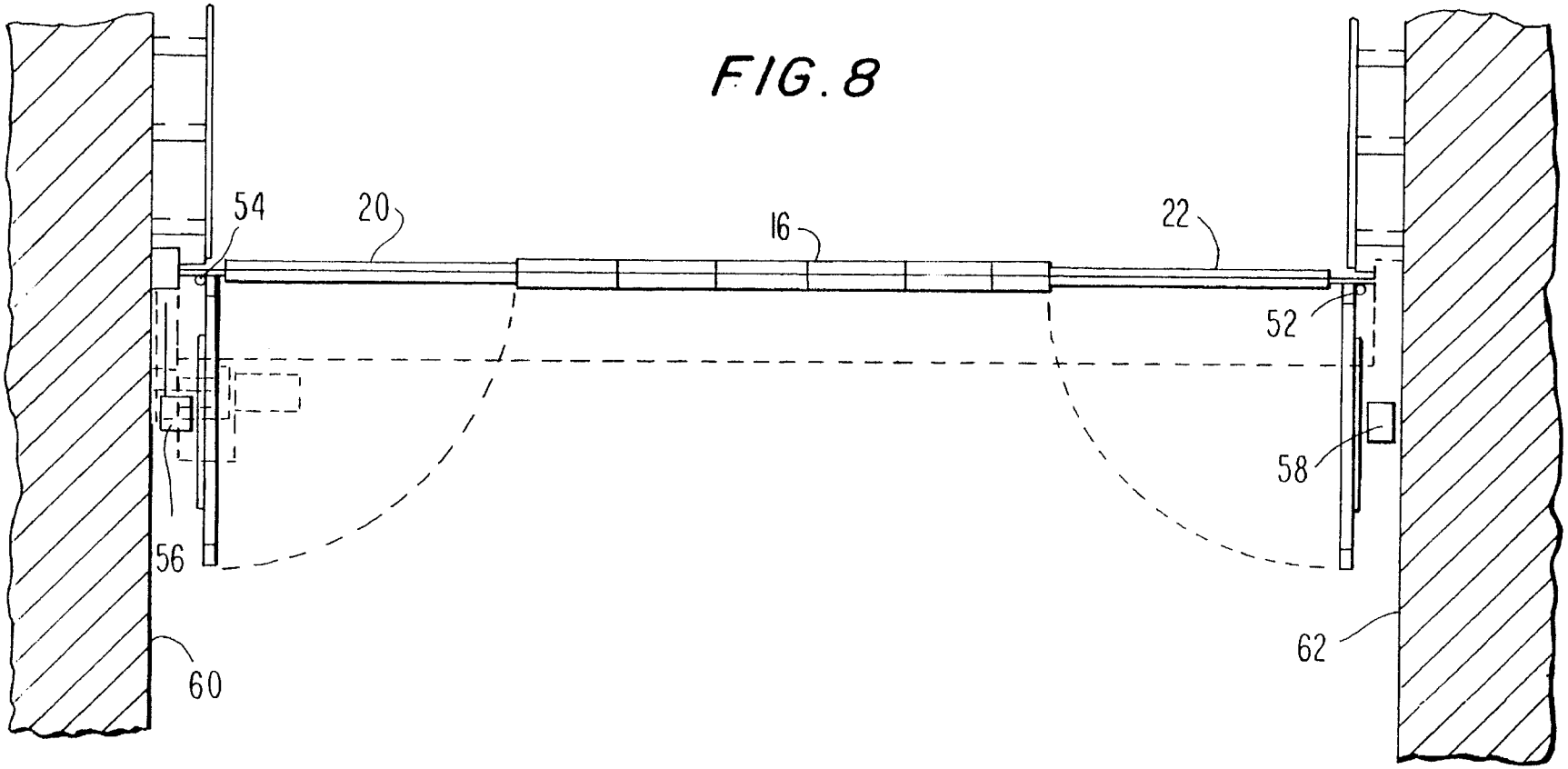
FIG. 8 is a plan view of the fire door assembly of FIG. 1, showing movement of the pass door flames from their respective inactive positions to the closed positions.

With simultaneous reference now to FIGS. 1 and 8, the means by which operation of the fire door assembly 10 is controlled will now be described in detail. As shown in FIG. 1, fire door assembly 10 includes a conventional fire door operator mechanism 50 for operating the rotating means 18 after a fire has been detected or upon manual activation of a test sequence. The construction of such mechanisms are well known to those skilled in the art, and a detailed description of the same has therefore been omitted as unnecessary. Typically, such structures include a fusible link mechanism which melts in response to a fire and, after a predetermined time delay, initiates extension of the flexible door panel across the opening.

In any event, and as will be readily ascertained by those skilled in the art, each of the pass door flames 20 and 22 must be in the transverse or closed position shown in FIG. 1 to achieve proper alignment of the flexible door panel therewith. Accordingly, prior to operation of the rotating means 18, pass door flames 20 and 22 must be moved from the inactive or open positions represented in dotted line form in FIG. 8 into their respective closed positions. In the illustrative embodiment depicted in FIG. 8, a tension spring 52, 54 biases pass door flames 20 and 22, respectively, into the closed or transverse positions. To retain the pass door frames 20 and 22 in their inactive positions, in which they are substantially aligned with lateral sidewalls 60 and 62, respectively, the present invention utilizes releasable, latching structures 56 and 58.

Any suitable releasable latching mechanisms may be utilized to retain pass door frames 20 and 22 in their respective closed positions. In the illustrative embodiment of the present invention, electromagnetic latches are utilized. While energized, the pulling force exerted by magnetic latching structures 56 and 58 on pass door frames 20 and 22, respectively, is sufficient to overcome the aforementioned bias and thus prevent the pass door flames from closing. Once latches 56 and 58 are de-energized, however, pass door frames 20 and 22 are free to move into the closed position shown in FIGS. 1, 3 and 8.

A variety of operating sequences of the door assembly 10 are possible in response to a test request or a detected condition such as a fire. For example, appropriate circuitry may be provided such that upon receipt of an external input signal indicative of a manual closure request, the supply of electrical power to latches 56 and 58 is disrupted and the doors may be permitted to close immediately. Alternatively, to avoid nuisance closures, capacitors (not shown) may be coupled between the power supply terminals and the magnetic latch structures such that a predetermined delay such, for example, as 10 seconds, is provided prior to de-energization of latches 56 and 58. Of course, appropriate circuitry should also be provided to delay extension of flexible door panel 16 until after the pass door frames have been released and/or moved into their closed positions.

While there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A fire door assembly for protecting a building opening defined by at least one lateral sidewall comprising:

a shutter roller rotatable about a substantially horizontal axis;

means for rotating said shutter roller;

a flexible panel windable on and off said roller for movement into retracted and extended conditions, respectively, said flexible panel defining an upper portion having a first width and a lower portion having a second width less than said first width;

a pass door frame hingedly securable proximate a lateral side of the opening for movement between a first position, in which said pass door frame extends in a substantially transverse direction relative to the opening and a second position, in which said pass door frame is substantially aligned with said at least one sidewall, said pass door frame defining a passage therethrough and a substantially vertical channel for guiding an edge region of said lower portion while in said first position;

a pass door movably mounted within the passage defined by said pass door frame to selectively provide ingress and egress therethrough; and closure means for causing said pass door frame to move frown said second position to said first position prior to extension of said flexible panel.

2. The fire door assembly of claim 1, wherein the lower portion of said flexible panel defines an increased thickness portion disposed along a bottom portion thereof, said fire door assembly further including a floating member defining a vertical slot having a length at least equal to the width of the lower portion of said flexible panel and a width less than the thickness of said increased thickness portion, said lower portion being positioned within said slot such that when the flexible panel is unwound the floating member assumes an aligning position relative to the flexible panel and pass door frame and when the flexible panel is wound up the floating member is removed from said aligning position.

3. The fire door assembly of claim 2, wherein said increased thickness portion comprises at least one elongated member coupled to said lower portion proximate a bottom edge thereof.

4. The fire door assembly of claim 3, wherein said increased surface portion comprises a single elongated member extending substantially across said second width.

5. The fire door assembly of claim 1, wherein said closure means includes means for biasing said pass door frame into said first position and releasable means for releasably retaining said pass door frame in said second position.

6. The fire door assembly of claim 5, wherein said releasable means is responsive to an externally supplied signal to release said pass door frame, thereby allowing said pass door frame to move into said first position.

7. The fire door assembly of claim 5, wherein said releasable means is an electromagnetic device.

8. The fire door assembly of claim 5, further including means for detecting a fire, said releasable means being responsive to said fire detecting means to release said pass door frame after a predetermined time delay.

9. The fire door assembly of claim 8, wherein said means for rotating said shutter roller is responsive to said fire detecting means to initiate extension of said flexible panel after said pass door frame has moved into said first position.

10. The fire door assembly of claim 1, wherein said closure means is responsive to an externally supplied signal to move said pass door frame from said second position into said first position.

11. The fire door assembly of claim 10, further including means for detecting a fire, said closure means being responsive to said fire detecting means to move said pass door frame into said second position after a predetermined time delay.

12. The fire door assembly of claim 11, wherein said means for rotating said shutter roller is responsive to said fire detecting means to initiate extension of said flexible panel after said pass door frame has moved into said first position.

13. The fire door assembly of claim 1, further including hinge means for hingedly securing said pass door frame proximate said lateral sidewall.

14. The fire door assembly of claim 1, wherein said pass door frame has a width no greater than a difference between the first width and said second width.

15. The fire door assembly of claim 1, further including a second pass door frame hingedly securable proximate a second lateral side of the opening for movement between a first position, in which said second pass door frame extends in a substantially transverse direction relative to the opening and a second position, in which said second pass door frame is substantially aligned with a second sidewall opposite said at least one sidewall, said second pass door frame defining a passage therethrough and a substantially vertical channel for guiding a second edge region of said lower portion while in said first position;

a second pass door movably mounted within the passage defined by said second pass door frame to selectively provide ingress and egress therethrough; and second closure means for causing said second pass door frame to move from said second position to said first position prior to extension of said flexible panel.

16. The fire door assembly of claim 15, wherein a sum of widths of said first and second pass door flames does not exceed a difference between the first width and second width.

17. The fire door assembly of claim 16, wherein said first and second pass door frames are of the same width.

18. The fire door assembly of claim 1, further including means for hingedly securing said pass door to said pass door frame.

19. A fire door assembly for protecting a building opening defined by at least one lateral sidewall comprising:

a shutter roller rotatable about a substantially horizontal axis;

means for rotating said shutter roller;

a flexible panel windable on and off said roller for movement into retracted and extended conditions, respectively, said flexible panel defining an upper portion having a first width and a lower portion having a second width less than said first width;

a pass door frame hingedly securable proximate a lateral side of the opening for movement between a first position, in which said pass door frame extends in a substantially transverse direction relative to the opening and a second position, in which said pass door frame is substantially aligned with said at least one sidewall, said pass door frame defining a passage therethrough and a substantially vertical channel for guiding an edge region of said lower portion while in said first position;

a pass door movably mounted within the passage defined by said pass door frame to selectively provide ingress and egress therethrough; and closure means for causing said pass door frame to move from said second position to said first position prior to extension of said flexible panel.

* * * * *